US005411424A

United States Patent [19]

Hill

[11] Patent Number: 5,411,424

[45] Date of Patent: May 2, 1995

[54] REPLACEABLE BUOY COVER

[76] Inventor: Jeffrey S. Hill, P.O. Box 245, Shell Knob, Mo. 65747

[21] Appl. No.: 71,320

[22] Filed: Jun. 2, 1993

[51] Int. Cl.[6] ..... B63B 22/16

[52] U.S. Cl. ..... 441/11; 441/6; 441/23

[58] Field of Search ..... 441/1, 6, 11, 21, 23; 114/219; 405/216

[56] References Cited

U.S. PATENT DOCUMENTS

| | | | |
|---|---|---|---|
| D. 278,803 | 5/1985 | Leo | D10/107 |
| 2,753,829 | 7/1956 | Agra | 114/219 |
| 3,360,811 | 1/1968 | Bartlebaugh | 441/6 |
| 3,448,585 | 6/1969 | Vogelsang | 405/216 |
| 3,590,406 | 7/1971 | Lockwood et al. | 9/8 |
| 3,604,030 | 9/1971 | Claflin | 9/8 |
| 3,660,856 | 5/1972 | Smulders | 9/8 P |
| 3,722,223 | 3/1973 | Gratz | 61/46 |
| 3,760,441 | 9/1973 | Handelman | 9/8 R |
| 3,875,602 | 4/1975 | Miron | 9/8.3 R |
| 3,939,509 | 2/1976 | Moore | 9/8 R |
| 4,033,023 | 7/1977 | Slaughter et al. | 29/401 B |
| 4,224,707 | 9/1980 | Mariani | 9/8 R |
| 4,280,237 | 7/1981 | Petrie | 9/8 R |
| 4,312,600 | 1/1982 | Schaaf et al. | 404/6 |
| 4,380,440 | 4/1983 | Suppa | 441/30 |
| 4,653,420 | 3/1987 | Johnson | 405/216 X |
| 5,096,448 | 3/1992 | Grey et al. | 441/1 |

*Primary Examiner*—Sherman Basinger
*Attorney, Agent, or Firm*—Litman, McMahon & Brown

[57] ABSTRACT

A replaceable buoy cover or buoy sock includes a tubular, cylindrical sleeve which is closed at a top end by a cap. A lower end of the sleeve is provided with a cinch member. The buoy cover is removably secured to a buoy by sliding the sleeve over the buoy until the cap contacts the top of the buoy. The cinch member is tightened to frictionally secure the cover on the buoy. When replacement of the buoy cover is required, the cinch member is cut to release the cover, and the cover is removed and replaced with a new cover. The replaceable buoy cover may be provided in standard marker buoy colors and has standard symbols or markings applied thereto.

15 Claims, 1 Drawing Sheet

Fig.1.
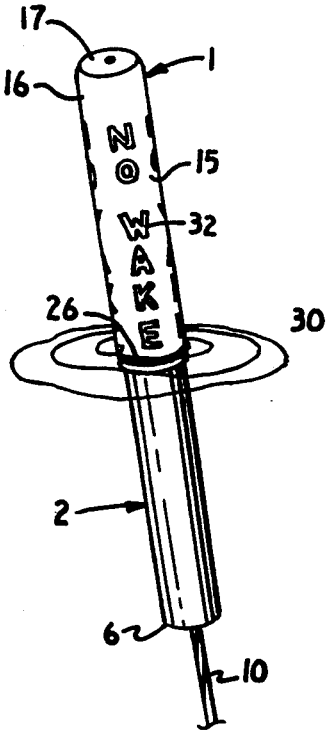
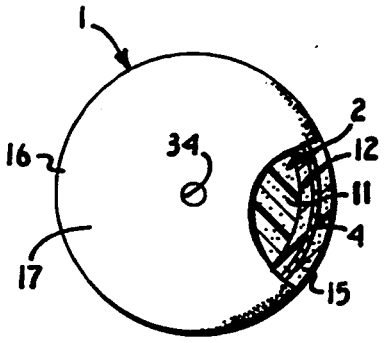
Fig.3.
Fig.2.
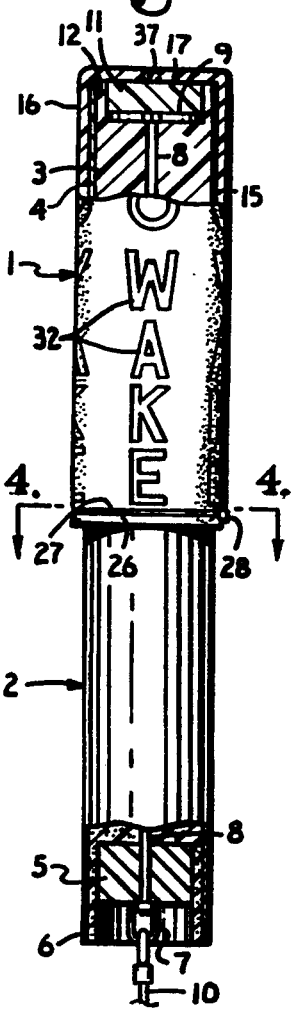
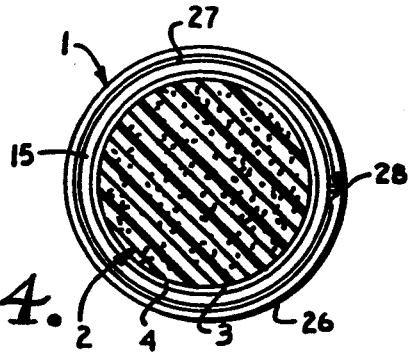
Fig.4.
Fig.5
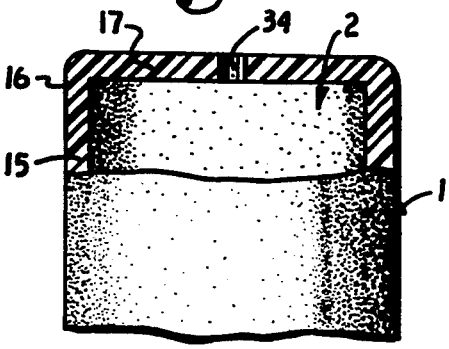
Fig.6.
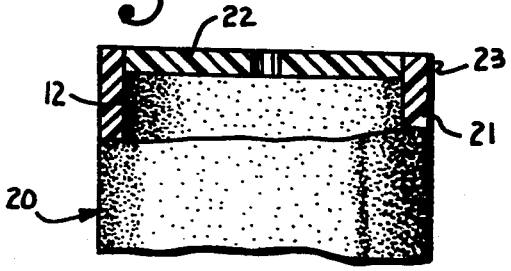

REPLACEABLE BUOY COVER

BACKGROUND OF THE INVENTION

Floating buoys are generally used on bodies of water, such as rivers, lakes, bays, and the like, to regulate boat traffic and to warn of water safety conditions. Buoys are used to mark navigation channels, to warn of underwater hazards, to mark areas off limits to boat traffic such as swimming areas, to mark areas in which certain boating operation regulations are in effect such as no-wake zones near marinas, and the like.

Marker buoys are typically elongated cylindrical structures which may be on the order of five to six feet in length and nine or ten inches in diameter. Such buoys are formed of rigid closed cell foams encased in a durable plastic, such as polyvinyl chloride (PVC). Ballast is positioned in the lower end to cause the buoys to float in an upright orientation, and the buoys are designed to have about 50 to 55% of their length extending above the water line. A buoy is held in place by a mooring cable secured to a mooring eye which is connected by a through-rod extending the length of the buoy to a top plate. Buoys are usually color coded according to the nature and urgency of their function and often have symbols or messages applied thereto by printing, application of decals, and the like.

Buoys are subject to deterioration over time due to their exposure to weather and ultraviolet radiation, collisions by boats, bird droppings, plant life such as algae, and pollutants which may be in the water in which the buoys float. Such factors can fade or otherwise obscure the color of the buoys and the markings thereon. Additionally, the structure of the buoys can be weakened from such factors. Buoys have been known to be broken completely in half when struck by boats. In order to avoid the possible consequences and liabilities which can result from inadequately marked channels and hazards, buoys must be inspected regularly and maintained when necessary by authorities and agencies responsible for regulating the bodies of water in which buoys are employed or by buoy tender companies contracted by such authorities and agencies.

Conventionally, buoy maintenance involves disconnecting the mooring cable or chain, lifting the buoy out of the water, cleaning and painting at least the exposed portion of the buoy, applying the required markings, either by the application of decals (including wrap-around vinyl decals) or stenciling the markings on the buoy, replacing the buoy in the water, and reconnecting the mooring tether. If a buoy is missing, broken in half, or otherwise damaged beyond repair, a new buoy must be installed. Such conventional buoy maintenance is laborious and time consuming and, thus, expensive both in terms of labor and materials. What is needed is a manner of maintaining buoys which, at a minimum, does not require that the buoy be removed from the water.

SUMMARY OF THE INVENTION

The present invention provides a structure which greatly improves the efficiency of maintaining buoys. The present invention generally provides a buoy covering structure, or buoy sock, for the nonsubmerged portion of a buoy which, after initial installation, can thereafter be simply replaced. The replaceable buoy cover is formed by a tubular sleeve which is closed at an upper end and has a cinch member at a lower end for removably securing the cover to the buoy. The buoy cover of the present invention is preferably provided in standard marker buoy colors and may either have the required symbols or markings preformed on the sleeve or have such markings applied as durable decals or printing. Neither initial installation nor replacement of the buoy cover requires that the buoy be removed from the water.

In an exemplary embodiment of the present invention, a replaceable buoy cover sleeve is formed of a closed cell, flexible foam rubber or plastic, as by extrusion or molding. The upper end of the sleeve is closed by a cap which may be either formed integrally with the sleeve or may be secured thereto, as by gluing, ultrasonic welding, or the like. The cinch member may be in the form of an extended length tie device, similar to what are referred to as cable ties, in which the end of the cinch member passes through a one-way ratchet fastener. Such a cinch member can be cut, as with cutter pliers, to enable removal of the buoy cover for replacement.

OBJECTS AND ADVANTAGES OF THE INVENTION

The principal objects of the present invention are: to provide a structure and method for maintaining marker buoys; to provide such a structure and method which does not require removal of a buoy from the body of water in which it floats for maintenance; to provide, particularly, a replaceable cover for a buoy; to provide such a cover including a tubular sleeve which is closed at an upper end by a cap and including a cinch member at a lower end to removably secure the cover to the buoy; to provide such a cover which is formed by a closed cell, flexible rubber or synthetic resin material; to provide such a cover which is provided in a variety of standard marker buoy colors and which has marker symbols or indicia preformed on the surface of the sleeve or which can be applied as durable decals, printing, or by other means; to provide such a cover which can be retrofitted to existing buoys as well as to newly manufactured buoys in a variety of sizes; to provide such a cover which protects buoys from deteriorating effects of weather, solar exposure, and other environmental factors; to provide such a cover which additionally provides buoys some measure of protection against damage from collisions by boats and other water craft; to provide such a cover which reduces the expense of labor and materials in maintaining buoys; and to provide such a replaceable buoy cover which is economical to manufacture, convenient to install, durable in use, and which is particularly well adapted for its intended purpose.

Other objects and advantages of this invention will become apparent from the following description taken in conjunction with the accompanying drawings wherein are set forth, by way of illustration and example, certain embodiments of this invention.

The drawings constitute a part of this specification, include exemplary embodiments of the present invention, and illustrate various objects and features thereof.

BRIEF DESCRIPTION OF THE DRAWING

FIG. 1 is a perspective view of a marker buoy having a replaceable buoy cover embodying the present invention installed thereon.

FIG. 2 is an enlarged side elevational view of the buoy with the replaceable buoy cover thereon, with portions broken away to illustrate details of the buoy and the buoy cover.

FIG. 3 is a further enlarged top plan view of the replaceable buoy cover with a portion of a cap of the cover broken away to illustrate details of a sleeve of the cover.

FIG. 4 is a further enlarged transverse sectional view taken on line 4—4 of FIG. 2 and illustrates details of the sleeve of the cover and a cinch member of the cover.

FIG. 5 is a greatly enlarged fragmentary side elevational view of a preferred embodiment replaceable buoy cover in which the cap is integrally formed with the sleeve, with a portion broken away to illustrate details thereof.

FIG. 6 is a view similar to FIG. 5 and illustrates an embodiment of the replaceable buoy cover having a cap member glued into the sleeve of the cover.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail:

The reference numeral 1 generally designates a replaceable buoy cover which embodies the present invention. The buoy cover or sock 1 is removably positioned on a marker buoy 2, principally to facilitate maintenance of the buoy 2 and additionally provides protection to the buoy 2 from factors which would deteriorate its functionality and, possibly, shorten the useful life of the buoy 2.

The buoy 2 is a typical marker buoy as is used to mark or define certain areas of a body of water for purposes of safety or boat traffic regulation. The illustrated buoy 2 is an elongated cylinder formed of a rigid, closed cell foam plastic body 3 which is encased in an outer skin 4 formed of a durable plastic, such as polyvinyl chloride (PVC). A ballast weight 5 is positioned at a lower end 6 of the buoy 2 to control the floating orientation of the buoy 2 whereby it normally floats in an upright orientation. The weight 5 may be a solid member or a granular weight, such as metal shot. A mooring eye 7 is connected by a through-rod 8 to a top plate 9 and provides for connection of an anchor cable or chain 10. A top insert 11 is positioned in a recess at a top end 12 of the buoy 2 in which the top plate 9 is mounted. Typical marker buoys 2 range in size from about 5 to 6 feet in length and 9 or 10 inches in diameter, and weigh from about 80 to 115 pounds.

The buoy cover 1 generally includes an elongated, tubular, cylindrical sleeve 15 which is closed at a top end 16 thereof by a cap 17. The cover 1 illustrated in FIGS. 2 and 5 has the cap 17 thereof formed integral with the sleeve 15. In a modified embodiment 20 of the replaceable buoy cover of the present invention illustrated in FIG. 6, a sleeve 21 of the cover 20 has a separately formed cap 22 which is secured to a top end 23 of the sleeve 21 by gluing, ultrasonic welding, or the like.

A lower end 26 of the cover 1 is provided with a cinch member 27 to retain the cover 1 on the buoy 2. The illustrated cinch member 27 is similar to types of tie devices used for bundling cables and referred to as cable ties. The cinch 27 has a one-way ratchet fastener 28 (see FIG. 4) in which the end of the cinch 27 is received and pulled to compress the lower end 26 against the surface of the buoy 2 to frictionally retain the cover 1 on the buoy 2. The cinch member 27 may be secured to the lower end 26 of the sleeve 15 as by gluing, welding, or the like. Alternatively, other types of buoy cover retaining devices could be provided on the cover 1, as would occur to one skilled in the appropriate art.

The sleeve 15 of the cover 1 preferably has a length to enclose the portion of the buoy 2 which projects out of the water 30 in which the buoy 2 floats. The cover 1 may be formed from any suitable waterproof material which is resistant to deterioration from solar exposure and general weathering and which is adequately resistant to damage from collisions with the buoy 2 by watercraft. The material from which the cover 1 is manufactured may, for example, be a closed cell, flexible synthetic resin foam, preferably, with a low friction outer surface finish for collision damage resistance.

It is also foreseeable that the sleeve 15 may be formed from a rectangular sheet of material having fastening means such as a hook and loop type fastener at opposed ends. To secure the cover to a buoy 2, the rectangular sheet of material would be wrapped around the buoy 2 to form the cylindrical tubular sleeve 15. The ends of the rectangular sheet of material would be secured together using the hook and loop type fastener, such that the sleeve 15 fits snugly about the buoy 2. The sleeve 15 may further be secured in place using cinch members 27.

The cover 1 may be manufactured in any standard marker buoy colors and may have indicia 32 applied thereto, such as standard symbols, warnings, traffic regulation messages, and the like. The illustrated cover 1 has the message "NO WAKE" applied thereto. Buoys 2 so marked are used in marina areas of lakes and coves with docks to warn boaters not to create wakes which can cause damage to boats moored in such areas. Such indicia 32 may be applied by hot stamping processes, by stenciling and painting, by adhesive application of decals, or by any other suitable process.

Buoy maintenance is greatly facilitated by use of the replaceable buoy cover 1 or 20. When maintenance of a buoy 2 is required, it is not necessary to remove the buoy 2 from the water 30 or to clean its surface. The buoy tender may simply slip a cover 1 onto the buoy 2 and secure the cinch 27. The cap 17 of the cover 1 is preferably provided with an aperture 34 to provide for the displacement of air within the cover 1 as it is slipped onto the buoy 2. When replacement of an existing cover 1 is necessary, the old cover 1 may be released by cutting the cinch 27, as with cutter pliers or the like, and removing the old cover. The buoy 2 may then be inspected for damage and, if the buoy 2 is still viable, a new cover 1 is sleeved onto the buoy 2.

The cover 1 can also be installed on newly manufactured buoys 2. Use of the cover 1 can economize the manufacture and stocking of buoys 2 since a standard buoy 2 of a given size can be manufactured without color coding or markings, the required color coding and markings being provided by the covers 1. Since the covers 1 are less expensive than the buoys 2, it is more economical to maintain a varied stock of covers 1 than a stock of buoys 2 having the various color codes and markings applied thereto.

It is to be understood that while certain forms of the present invention have been illustrated and described herein, it is not to be limited to the specific forms or arrangement of parts described and shown.

What is claimed and desired to be secured by letters patent is as follows:

1. A replaceable buoy cover and buoy wherein said buoy is adapted to be anchored in a body of water by an anchoring line connected to a lower end of said buoy, said cover and buoy comprising:

(a) sleeve means of a size and shape to cover only a portion of said buoy;

(b) said sleeve means being sized and shaped to be replaceably positioned in covering relation to said portion of said buoy with said buoy received therein without disconnecting said anchoring line from said buoy;

(c) retaining means for releasably retaining said cover on said buoy; and (d) indicia applied to said sleeve means.

2. A cover and buoy as set forth in claim 1 wherein said retaining means comprises:

(a) cinch means positioned at a lower end of said sleeve means and being drawn to removably secure said sleeve means to said buoy.

3. A cover and buoy as set forth in claim 1 and including:

(a) cap means closing said sleeve means at one end thereof.

4. A cover and buoy as set forth in claim 1 wherein:

(a) said sleeve means is formed of a flexible, closed cell, synthetic resin foam material.

5. A replaceable buoy cover and a substantially cylindrical buoy adapted for use in a body of water and having an upper portion, a lower portion, and a cylindrical surface, said cover and buoy comprising:

(a) a substantially tubular sleeve;

(b) a cap substantially closing an upper end of said sleeve, an opposite lower end of said sleeve being open;

(c) cinch means positioned at said lower end of said sleeve; and (d) said sleeve being removably positioned in covering relation to said upper portion of said buoy with said buoy received through said lower end of said sleeve and said cinch means being drawn to compressively and removably secure said sleeve to said cylindrical surface of said buoy whereby said cover is replaceable without removing said buoy from said body of water.

6. A cover and buoy as set forth in claim 5 wherein:

(a) said cap is formed integrally with said sleeve.

7. A cover and buoy as set forth in claim 5 and including:

(a) buoy indicia formed on an external surface of said sleeve means.

8. A cover and buoy as set forth in claim 5 wherein:

(a) said sleeve means is formed of a material having a standard buoy marker color.

9. A cover and buoy as set forth in claim 5 wherein:

(a) said sleeve means is formed of a flexible, closed cell, synthetic resin foam material.

10. A method of maintaining a substantially cylindrical buoy having a cylindrical surface and which is anchored in place in a body of water by an anchoring line connected to means on said buoy, and comprising the steps of:

(a) forming a buoy cover sleeve having a size and shape to cover an upper portion of said buoy and having cinch means at a lower end thereof;

(b) approaching an in-service buoy previously positioned in a body of water;

(c) removably positioning said sleeve in covering relation to said upper portion of said in-service buoy without removing said in-service buoy from said body of water and without disconnecting said buoy from said an anchoring line; and (d) removably securing said sleeve to said buoy by drawing said cinch means to compressively engage said lower end of said sleeve to said cylindrical surface of said buoy.

11. A method as set forth in claim 10 and including the step of:

(a) forming said sleeve with a cap at an upper end of said sleeve to close said upper end thereof.

12. A method as set forth in claim 11 and including the step of:

(a) forming said sleeve and cap as a one piece unit.

13. A method as set forth in claim 10 and including the step of:

(a) applying indicia means to an external surface of said sleeve.

14. A method as set forth in claim 10 and including the step of:

(a) forming said sleeve of a material having a standard buoy marker color.

15. A method as set forth in claim 10 and including the step of:

(a) forming said sleeve of a flexible, closed cell, synthetic resin foam material.

* * * * *